United States Patent [19]

Arnulf

[11] Patent Number: 4,998,746

[45] Date of Patent: Mar. 12, 1991

[54] SKI BINDING HAVING INTEGRAL BIASING AND SUPPORT MEMBERS

[75] Inventor: Paul Arnulf, Alby Sur Cheran, France

[73] Assignee: Salomon S.A., Annecy Cedex, France

[21] Appl. No.: 325,009

[22] Filed: Mar. 15, 1989

Related U.S. Application Data

[63] Continuation of Ser. No. 51,393, May 19, 1987, abandoned.

[30] Foreign Application Priority Data

May 21, 1986 [FR] France ..... 8607229

[51] Int. Cl.[5] ..... A63C 9/20

[52] U.S. Cl. ..... 280/615; 280/607; 280/609

[58] Field of Search ..... 280/615, 609, 636, 618, 280/607

[56] References Cited

U.S. PATENT DOCUMENTS

| | | | |
|---|---|---|---|
| 4,083,578 | 4/1978 | Moog et al. | 280/625 |
| 4,191,396 | 3/1980 | Biermann et al. | 280/615 |
| 4,382,611 | 5/1983 | Salomon | 280/615 |
| 4,484,762 | 11/1984 | Salomon | 280/615 |
| 4,496,169 | 1/1985 | Salomon et al. | 280/615 |
| 4,714,267 | 12/1987 | Abondance et al. | 280/615 |
| 4,844,503 | 7/1989 | Dunand | 280/607 |

FOREIGN PATENT DOCUMENTS

| | | | |
|---|---|---|---|
| 72766 | 2/1983 | European Pat. Off. | 280/615 |
| 0167462 | 1/1986 | European Pat. Off. . | |
| 2954446 | 5/1980 | Fed. Rep. of Germany | 280/615 |
| 3518400 | 12/1985 | Fed. Rep. of Germany | 280/615 |
| 2447731 | 8/1980 | France . | |
| 2497674 | 7/1982 | France . | |
| 2537011 | 6/1984 | France . | |

*Primary Examiner*—David M. Mitchell

*Attorney, Agent, or Firm*—Sandler, Greenblum & Bernstein

[57] ABSTRACT

An apparatus for linking a ski boot to a ski, including an elastically flexible support mounted for pivoting around a transverse journal axis on a longitudinally extending ski. The apparatus includes a rigid element adapted to couple the ski to the front of the boot with a portion of a retention element, at least partially embedded in the support and positioned to intersect the transverse axis. An elastic device is provided for biasing the support to rotate in a direction towards the rear and bottom of the ski.

39 Claims, 4 Drawing Sheets

4 / 4
FIG.13
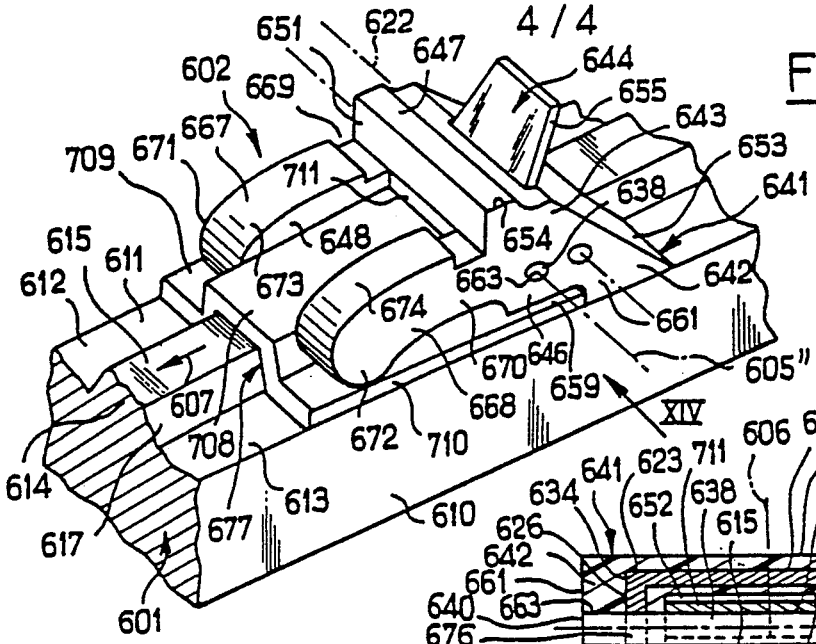
FIG.15
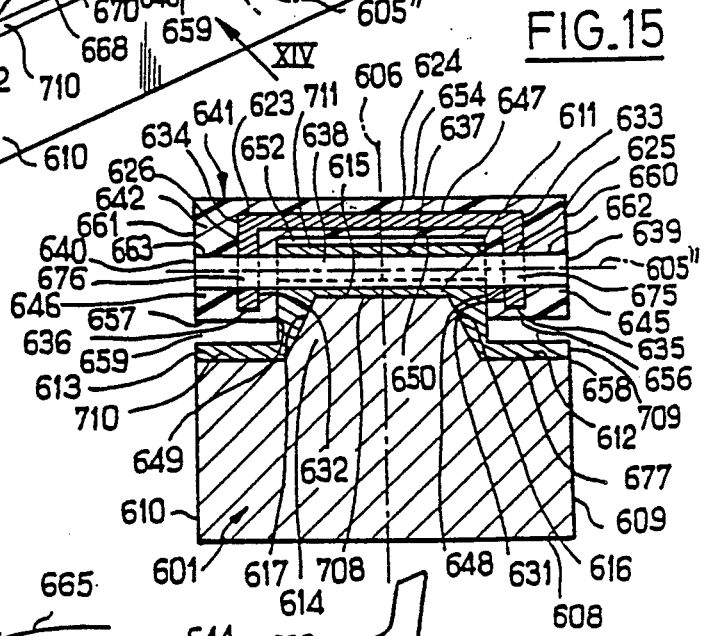
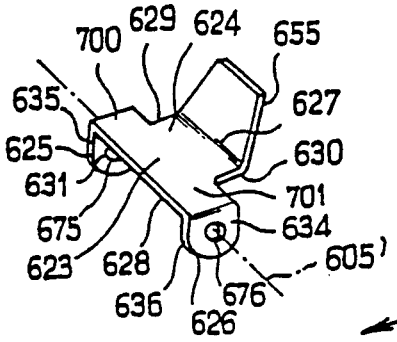
FIG.16
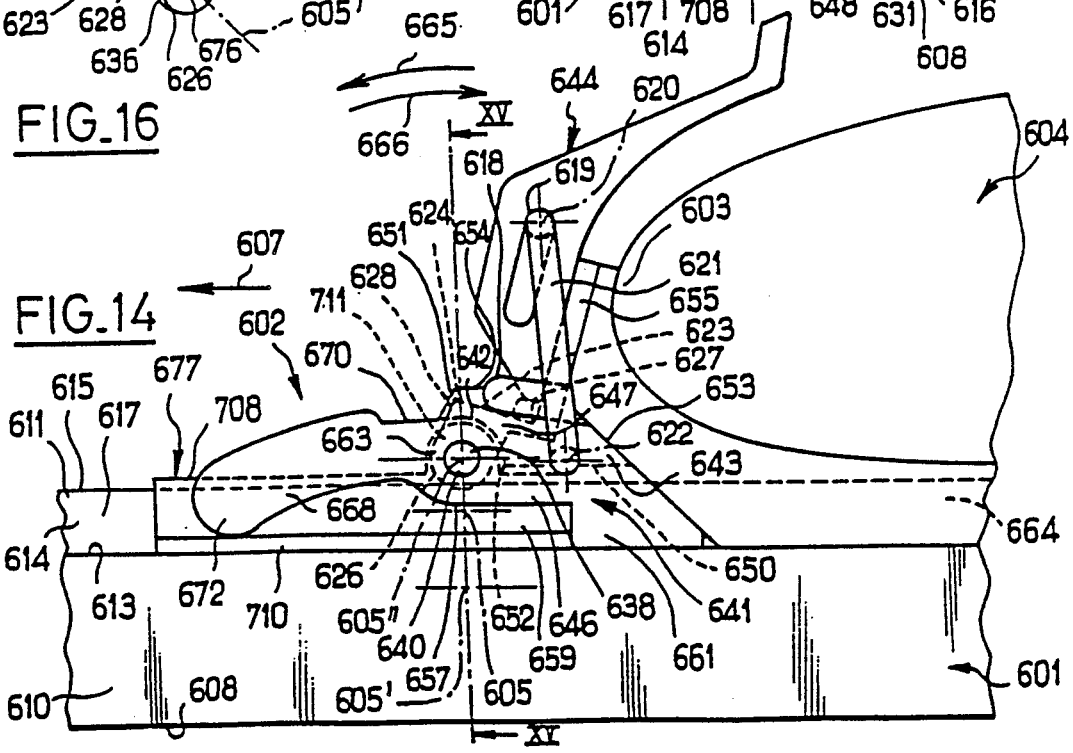
FIG.14

SKI BINDING HAVING INTEGRAL BIASING AND SUPPORT MEMBERS

This application is a continuation, of application Ser. No. 07/051,393, filed May 19, 1987.

BACKGROUND OF THE INVENTION

1. Field of the Invention

The present invention relates to a ski binding or linkage apparatus for attaching the front end of a boot to a ski, particularly for use in cross-country skiing.

More specifically, the invention relates to a linkage apparatus of the type commonly referred to as a binding which includes:

(a) a support, which is adapted to be pivotably mounted around a transverse axis on a ski, for retention apparatus for a front end of the boot adapted to cooperate with a rigid boot support element attached to the support and adapted to receive the front end of the boot in a fitted but removable fashion; and (b) elastic means for biasing the support for pivoting with respect to the ski around the transverse axis, in a predetermined direction, i.e., towards the rear and downwardly on the ski.

2. Description of Background and Relevant Information

In the previous discussion as well as in what follows, the directions of top, bottom, front, and rear are made in reference to the normal position of use of the ski, assumed to be resting flat on an approximately horizontal surface, as well as to the normal direction of displacement of the ski.

Apparatus of the previously described above type are generally known. Representative examples of such apparatus are described in French Patent Application No. 2 447 731, commonly owned with the present application, particularly with reference to FIGS. 29 and 30, in addition to French Patent Application No. 2 537 011, also commonly owned with the present application, particularly with reference to FIGS. 8 and 9 of this document.

In these types of conventional ski binding and linkage apparatus, the rigid element attached to the support is typically made of a metallic substance, which exhibits good characteristics of rigidity and mechanical resistance to allow for its cooperation with the boot, particularly by engagement with retention apparatus, e.g., in the form of a buckle, on the front end of the boot. Inasmuch as this type of assembly is often somewhat cumbersome, the support may be formed of a plastic material in which the rigid element is partially embedded. This assures a more or less flexible linkage of the rigid element with a transverse journal axis on the ski.

The elastic means for biasing the support can be structurally distinct from the support, as is shown for example in FIGS. 29 and 30 of French Patent Application No. 447 731, and FIG. 8 of French Patent Application No. 2 537 011. However, when the support has the desired elastic flexibility, these elastic bias means can also be formed integrally with the support from one piece of plastic material, as is illustrated in FIG. 9 of French Patent Application No. 2 537 011. Although integral construction of these elements may simplify the manufacture of the linkage apparatus, such construction does not result with a binding system which is necessarily universally compatible. In general, an integral support and elastic bias means unit is often only compatible with essentially flexible linkage between the rigid element adapted to receive the front end of the boot and the journal axis on the ski.

A goal of the present invention is to provide a linkage apparatus wherein the elastic means for biasing the support is integral or unitary with the support in a manner which is compatible with a rigid linkage between the transverse journal axis of the support on the ski and the rigid retention apparatus on the front end of the boot or shoe.

SUMMARY OF THE INVENTION

An object of the present invention is to provide an apparatus for linking a boot to a ski which includes a support having a longitudinal axis and a transverse axis, and a bottom adapted to be mounted to a surface on a ski for pivoting about the transverse axis; means for biasing at least a portion of the bottom of the support against the surface on a ski fitted to one end of the support; and means for attachment to a boot including an extended section projecting outwardly from an opposite side of the support, a base fixed at one end to the extended section secant to the transverse axis at least partially embedded in the support, preferably wherein the support as well as the means for biasing are formed at least partially from elastic, flexible material, and wherein the means for biasing preferably has an arched underside and an end portion opposite the end fitted to the support which is adapted to contact the surface on the ski.

Another object of the present invention is to provide an apparatus for linking a boot to a ski, as described above, wherein the support is provided with a cylindrical passage having a longitudinal axis coincident with the transverse axis of the support, preferably wherein the base of the means for attachment is attached to an extension defining a circular area having a center coincident with this transverse axis, and a journal extends through the cylindrical passage of the support and the circular area of the extension.

Another further object of the present invention is to provide an apparatus for linking a boot to a ski, as described above, wherein the support includes a central portion and lateral sections which are provided with bores as extensions of the cylindrical passage, preferably wherein the central portion has a bottom surface and the lateral sections have lower surfaces located below the bottom surface of the central portion to enable the lower surfaces of the lateral section to make contact with the surface on a ski to which the apparatus is mounted, wherein the central portion and the lateral sections define an open or hollow area preferably adapted to mate with raised area on a top of a ski, and preferably wherein the means for biasing includes two members fixed to one end of each of the lateral sections of the support.

Another still further object of the present invention is to provide an apparatus for linking a boot to a ski, as described above, wherein the base for the means for attachment has opposite side edges, and the extension of the means for attachment includes side plates extending downwardly from the opposite side edges of the base which are parallel to each other and perpendicular to the transverse axis of the support and are provided with a circular opening describing the circular area having a diameter essentially the same as the diameter of the cylindrical passage for receiving end portions of the journal.

It is another object of the present invention to provide an apparatus for linking a boot to a ski, as described above, wherein the surface on a ski to which the apparatus of the present invention is mounted is a platform adapted to be fitted on top of a ski.

It is another further object of the present invention to provide an apparatus for linking a boot to a ski, as described above, wherein the apparatus includes a frame or stand adapted to be mounted to a ski composed of a frame base for attachment to the ski, and stanchions which have a lower end attached to each side to the frame base and an upper end portion with a circular opening having a center coincident with the transverse axis positioned so as to receive ends of the journal, preferably wherein the extended section of the means for attachment has side edges and the base of the means for attachment has lateral sides with sections spaced apart by a distance greater than the distance between the side edges of the upper extended section, preferably wherein the extension includes side plates attached to each of the sections of the lateral sides. Alternatively the extension of the base of the means for attachment is preferably shaped into a cylinder having a hollow central area for receiving the journal which is preferably longer than the distance between the side edges of the upper extended section of the means for attachment, and is preferably fixed in the hollow central area of the extension.

It is another still further object of the present invention to provide a means for attachment adapted to connect a boot with a ski which is composed of a base having a surface in a plane including an end portion, an opposite end portion and opposite sides; an element having a surface in another plane defining a circular opening with a center attached to the end portion of the base; and a generally elongate member having a surface in a third plane attached to the other end portion of the base, wherein the element includes a side plate extending from each of the opposite sides of the base surface such that the center of each circular opening is coincident with a common axis, and preferably wherein the surface of the base is secant to this axis.

It is yet another still further object of the present invention to provide a means for attachment, as described above, wherein the generally elongate member has lateral sides, and the opposite sides of the base surface have edges which include sections spaced apart by a distance greater than the distance between the lateral sides of the elongate member, preferably wherein the element attached to the end portion of the base has a cylindrical shape with a hollow central area and is longer than the width or distance between the lateral sides of the elongate member, and preferably wherein a journal having a length longer than the element is fitted in the hollow central area so that end portions of the journal project from the cylindrical shape.

Another object of the present invention is to provide a support adapted to receive means for attachment to a boot for mounting to a ski which includes a support having a longitudinal axis, a transverse axis, and a bottom adapted to be mounted to a surface on a ski for pivoting about the transverse axis, and means for biasing at least a portion of the bottom of the support against a surface on a ski fitted to one end of the support, wherein the means for biasing and the support are composed of elastic, flexible material, and preferably wherein the means for biasing has an arched underside adapted to contact a surface on a ski at an end portion opposite the end fitted to the support. The support is preferably provided with a cylindrical passage having a longitudinal axis coincident with the transverse axis through the support, and preferably includes a central portion and lateral sections, which are provided with extensions of the cylindrical passage as bores, preferably wherein the central portion has a bottom surface and each of the lateral sections has a lower surface located below the bottom surface of the central portion for contact with a surface on a ski so that the central portion and the lateral sections define a hollow area.

Another further object of the present invention is a support adapted to receive means for attachment to a boot, as described above, wherein a journal is provided to extend through the cylindrical passage so as to connect the support to a ski. Preferably the support also includes a stand or frame adapted to be mounted on a top surface of a ski which includes a stand or frame base for attachment to a ski, and stanchions connected at one end to a lateral side of the base having an opposite end portion with a circular opening having a center coincident with the transverse axis through the support for receiving ends of the journal.

It is another object of the present invention to provide an apparatus for skiing which includes a ski having a top side, and a linkage apparatus attached to the top side of the ski which is composed of a support having a longitudinal axis, a transverse axis, and a bottom adapted to be mounted to a surface on the ski for pivoting about the transverse axis; means for biasing at least a portion of the bottom of the support against the surface on the ski fitted to one end of the support; and means for attachment to a boot associated with the support which includes an upper extended section projecting outwardly from an opposite end of the support, and a base plate fixed at one end to the extended section secant to the transverse axis through the support at least partially embedded in the support, preferably wherein the support and the means for biasing are formed at least partially from elastic, flexible material, and wherein the means for biasing preferably has an arched underside and an end portion opposite the end fitted to the support which contacts the upper surface on the ski. The support is preferably provided with a cylindrical passage having a longitudinal axis coincident with the transverse axis and the means for attachment further includes a lower extension defining a circular area having a center coincident with the transverse axis fixed to another end of the anchor plate and also includes a journal extending through the cylindrical passage in the circular area.

Another further object of the present invention is an apparatus for skiing, as described above, wherein the support member includes a central portion and lateral sections provided with bores as extensions of the central passage, wherein the central portion has a bottom surface and the lateral wing sections have lower surfaces located below the bottom surface for contact with the surface on the ski wherein the central portion and the lateral sections define a hollow area adapted to mate with a raised area on the surface of the ski, preferably wherein the means for biasing are fixed at one end at each of the lateral sections of the support.

Another still further object of the present invention is to provide apparatus for skiing, as described above, wherein the base plate has opposite side edges and the lower extension includes side plates extending downwardly from the side edges of the base plate which are parallel to each other and perpendicular to the transverse axis and are provided with a circular opening describing a circular area having a diameter essentially the same as the diameter of the cylindrical passage receiving end sections of the journal, preferably wherein the surface on the ski to which the linkage apparatus is mounted is a platform adapted to be fitted to an upper surface area of the ski.

Another yet still further object of the present invention is to provide an apparatus for skiing, as described above, which also includes a frame or stand adapted to be mounted to the ski which includes a base having sides for attachment to the ski, and stanchions with lower ends attached to the sides of the base and upper end portions having a circular opening with a center coincident with the transverse axis positioned so as to receive ends of the journal, preferably wherein the upper extended section of the means for attachment has a width and the base plate has a section with a width greater than the width of the upper extended section. The lower extension is preferably shaped into a cylinder having a hollow central area for receiving the journal, which is preferably fixed in the hollow central area of the extension.

Another object of the present invention is to provide an apparatus for skiing, as described above, wherein the lower surfaces of the lateral sections of the support are fixed to a surface on the ski, preferably wherein such surface is a base attached to the top side of the ski. The lateral sections of the support may be in the form of stanchions to form a frame with the base for pivotally mounting the linkage apparatus on the ski by means of a journal extending through the passage in the support, the open circular area of the lower extension of the means for attachment, and the bores in the stanchions.

Another further object of the present invention is to provide an apparatus for skiing, as described above, wherein the upper surface of the ski includes a longitudinally extending rib having a top surface and longitudinal laterally adjacent surfaces, wherein the top surface of the rib and the top surface side of the ski may lie in a common horizontal plane.

Another still object further object of the present invention is to provide a skiing apparatus, as described above, wherein the longitudinally extending rib includes lateral sides extending between the top surface of the rib and the laterally adjacent surfaces of the upper surface of the ski which mutually converge in a forward direction and are mutually parallel over at least a section of the rib.

It is another object of the present invention to provide a skiing apparatus, as described above, wherein the surface on a ski to which the linkage apparatus is attached is a platform fitted to overlap the section of longitudinally extending rib which includes mutually parallel lateral sides.

It is another further object of the present invention to provide a skiing apparatus including a linkage apparatus for coupling a front end of a boot to a ski which includes a support provided with a cylindrical passage having a longitudinal axis coincident with an axis transverse to a longitudinal axis of a ski, adapted to be pivotally mounted about such transverse axis to the ski; means for supporting a front end of a boot connected to the support which includes a base plate at least partially embedded in the support secant to the transverse axis and adapted to be pivotally connected about the transverse axis, and an elongate member attached at one end to the base plate and extending outwardly from an end of the support, which is adapted to cooperate with means for attachment to the boot; and means for biasing the support about the transverse axis with respect to the ski attached to another end cf the support, preferably wherein the means for support also includes mutually parallel side plates attached to the base plate perpendicular to the transverse axis provided with openings with a center coincident with the transverse axis adapted to receive a journal.

It is another still further object of the present invention to provide an apparatus for skiing, as described above, in combination with a ski having a longitudinal raised top portion provided with a tunnel along an axis coincident with the transverse axis; and a journal extending along the transverse axis through the tunnel, the passage and the openings to pivotally connect the linkage apparatus to the ski.

It is still another object of the present invention to provide a skiing apparatus, as described above, wherein the side plates are positioned at each side of the raised top portion of a ski, which is preferably a longitudinal rib positioned secant to the transverse axis, which may be an integral part of the ski or attached to a top surface of the ski.

It is yet another further object of the present invention to provide a skiing apparatus, as described above, wherein the means for biasing includes at least one flexible member having an arched underside and a free end with a bottom portion for contacting an upper surface on the ski, wherein the support is made from flexible, elastic material and a means for biasing include two flexible members positioned on each side of the rib.

Another object of the present invention is to provide a skiing apparatus, as described above, wherein the means for support also includes a tube attached to the base plate having a longitudinal axis coincident with the transverse axis, preferably wherein the apparatus also includes a frame having a base adapted to be attached to a top surface area of the ski including stanchions connected to each lateral side of the base having openings with a center coincident with the transverse axis adapted to receive a journal extending along the transverse axis to project from the tube and through the passage, preferably wherein the journal is integrally fixed in the tube, and the tube is located between the stanchions.

BRIEF DESCRIPTION OF THE DRAWINGS

Other characteristics and advantages of the present invention will become clear from the description which follows, given by way of various non-limiting embodiments, with reference to the annexed drawings in which:

FIGS. 5–8 are views which are respectively analogous to those of FIGS. 1–4 showing a second embodiment of an apparatus according to the invention wherein FIG. 6 illustrates a lateral elevational view along arrow VI of FIG. 5 and wherein FIG. 7 illustrates a cross-sectional view along a transverse plane identified as VII—VII of FIG. 6;

FIGS. 13–16 are views analogous to those of FIGS. 1–4, respectively, of a third embodiment of an apparatus according to the invention, wherein FIG. 14 illustrates a lateral elevational view along arrow XIV of FIG. 13 and FIG. 15 illustrates a cross-sectional view through a transverse plane identified as XV—XV of FIG. 14.

DESCRIPTION OF PREFERRED EMBODIMENTS

Figure 1:
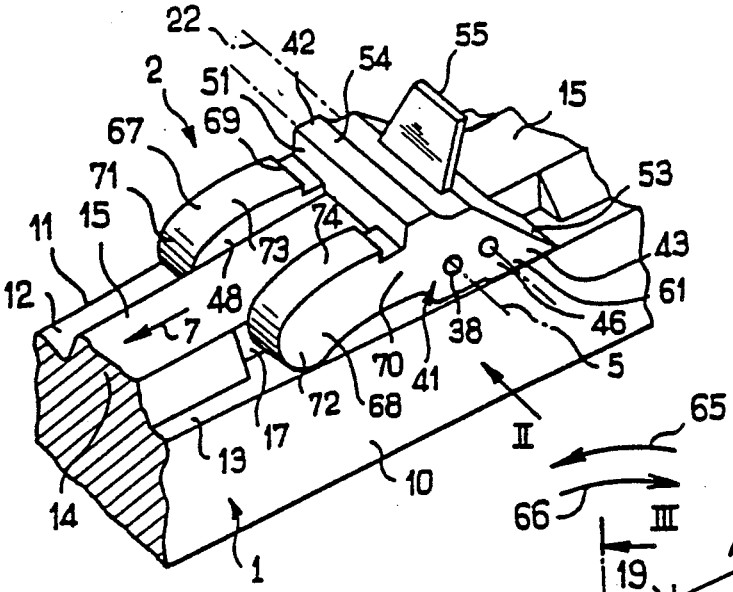
FIG. 1 is a perspective view of a first embodiment of the linkage apparatus of the present invention, shown mounted on a ski, with a relatively simple conventional retention apparatus for a front end of the boot on the support, for example of the type described by French Patent Application No. 2 447 731, and corresponding U.S. Pat. Nos. 4,382,611 and 4,484,762 commonly owned with the present application, the disclosure of which is hereby incorporated by reference thereto, wherein the apparatus according to the present invention is illustrated in a maximum displacement limit of the support towards the rear and towards the bottom of the ski.

The apparatus for linking a boot to a ski according to the invention is characterized in that the rigid means for attachment to the boot includes an attached upper extended section secant to the axis of the pivot or journal which is at least partially embedded in an integral fashion in a support which is formed of an elastically flexible material and includes an elastic bias means.

One thus obtains in a particularly simple fashion, from a structural point of view as well as from the point of view of manufacture, both a rigid linkage between the pivot or journal and the means for attachment to the front end of the boot, as well as an elastic bias means whose rigidity can be varied as desired independently of any consideration relative to the linkage between the pivot and the means for attachment.

According to one embodiment of the apparatus according to the present invention, the rigid means for attachment includes a cap, base or plate including two mutually parallel extensions tabs or fins which are perpendicular to the axis of the pivot. The fins are adapted to cooperate with a corresponding element on the ski by means of a pivot or journal positioned along a pivot axis. This corresponding element on the ski can be positioned between the extensions of the base of the means for attachment along the pivot axis, and preferably includes a longitudinal rib on the top surface of, or raised area fastened to or integral with the ski, positioned between the extension secant to the pivot axis. The corresponding element can also be positioned on both sides of the means for attachment, e.g., as frame to support the apparatus along the pivot axis.

In other embodiments of the apparatus according to the invention, the extension of the base of the means for attachment can be in the form of a tubular sleeve positioned along the pivot axis and adapted to cooperate with a corresponding element attached to the ski by means of a pivot positioned along this axis. Alternatively the pivot or journal may be an integral part of the extension of the base of the means for attachment positioned along the pivot axis which is adapted to cooperate with a corresponding element attached to the ski. In such cases, the corresponding element is preferably positioned on both sides of the extension along the axis, e.g., as a frame to support the apparatus.

In all cases, the corresponding element can be made integral with the ski or attached to the ski in a relatively secure and rigid fashion.

According to a preferred embodiment, the construction of the elastic means for biasing the support is such that the support, made of an elastically flexible material, has at least one elastically flexible tongue having a bottom portion for contact with the ski and extending towards the front with respect to the extension of the means for attachment.

In the case of a ski including an upper longitudinal surface having a longitudinal rib, the support, as well as the means for biasing, are preferably made of elastically flexible material and the means for biasing includes two elastically flexible tongues, positioned on both sides of the rib and attach to lateral sections on either side of a central portion of the pivot and support zones of the support. One of the modes of support described in French Patent Application No. 2,447,737 or in French Patent Application No. 2,537,011 both of which are commonly owned with the present application, and corresponding U.S. Ser. No. 558,858, now abandoned, and U.S. Pat. Nos. 4,382,611 and 4,484,762, respectively; and can be adopted for this purpose by way of non-limiting example, the disclosures of which are hereby incorporated by reference thereto.

Turning first to FIGS. 1–4, a zone of a ski 1 such as a cross-country ski, and more specifically a median zone of the ski, is illustrated provided with a linkage apparatus according to the present invention, designated generally as element 2, adapted to secure the coupling of a front end 3 of a boot 4 with the ski 1, in a manner which permits relative pivoting around an axis 5 by means of a journal or pivot attached so as to be positioned transversely with respect to the longitudinal axis of ski 1 and boot 4, i.e., more precisely perpendicularly to a longitudinal median plane 6 (shown in FIG. 3) of ski 1.

For purposes of ease of understanding in the description which follows, this plane 6 will be assumed to be vertical and axis 5 horizontal. Related to this, it will be assumed that ski 1 is itself horizontal and placed in a normal position of use, i.e., the longitudinal direction 7 constitutes the normal direction of displacement of the ski when the ski is horizontal. Naturally, the orientation and level references which will follow therefrom in the description below should only be taken as indications of relative positioning, without implying limitation as to the conditions of use of the apparatus according to the invention. The preceding will likewise apply to the other embodiments of apparatus according to the invention, which are likewise described in a normal position of use of the ski.

The ski 1 which is illustrated is the type referred to as being edged. Thus, the ski has a longitudinal bottom or sole surface 8 in its longitudinal median zone which is approximately planar and horizontal as well as being perpendicular to plane 6, in addition to two side surfaces 9 and 10 which are likewise longitudinal, approximately planar and positioned symmetrically to one another with respect to plane 6, i.e., parallel to plane 6, and an upper surface 11 which is likewise longitudinal, so that the side surfaces 9 and 10 connect to bottom surface 8. In characteristic fashion, the upper surface 11 of ski 1 has, at its respective junctions with side surface 9 and with the side surface 10, two longitudinal strips 12 and 13 which are symmetrical to one another with respect to plane 6, in addition to being approximately planar and coplanar as well as approximately parallel to bottom surface 8, i.e., approximately horizontal, in the longitudinal median zone of the ski. These two strips 12 and 13 of the upper surface border a longitudinal raised area or rib 14 of ski 1. The rib 14 is positioned symmetrically with respect to plane 6 and has, at least in a zone positioned around axis 5, a rectangular transverse cross-section. This cross-section of rib 14 is defined by a longitudinal top surface 15, which is offset upwardly with respect to strips 12 and 13, and generally parallel to strips 12 and 13 in the longitudinal median zone of the ski, and by two lateral surfaces 16 and 17, respectively, connecting top surface 15 to strips 12 and 13. The lateral surfaces 16 and 17 are substantially planar in the median zone of the ski and are positioned symmetrically to one another with respect to plane 6, as well as being parallel to plane 6. The previously described shape of rib 14, however, is only one non-limiting example and one can alternatively provide a rib 14 which is asymmetrical with respect to plane 6 as well as strips 12 and 13 which are mutually asymmetrical with respect to plane 6 In this regard, it should be noted that outside of the median zone of the ski, rib 14 can extend longitudinally in rectangular or other cross-section, and may for example be trapezoidal or triangular, or can be interrupted as is well known. One of ordinary skill in the art will be able to adapt without difficulty and without going beyond the scope of the present invention, the linkage or binding apparatus 2 according to the present invention to such variations in the configuration of rib 14 in view of the following description of the linkage apparatus.

Axis 5 cuts or passes transversely through the ski 1, preferably through rib 14, which is bored with a passage 37 opening into surfaces 16 and 17. The passage 37 has a cylindrical form of revolution around axis 5 with a diameter such that this passage is integral with rib 14 in an area between top surface 15 and strips 12 and 13 on the upper surface of the ski. To this end, the diameter of the passage is less than twice the smaller of the distances separating axis 5 from top surface 15 and strips 12 and 13, respectively.

The passage 37 receives a coaxially placed pivot or journal 38 of a generally cylindrical form of revolution around axis 5 with a diameter substantially identical to the diameter of passage 37. It should be understood that one can either provide a stop for this pivot 38 in opening 37 both against rotation around axis 5 as well as against translation parallel to axis 5 by any appropriate means. Alternatively, one can provide for free rotation of pivot 38 in opening 37 as will be further discussed herein.

Along axis 5, i.e., perpendicular to plane 6, pivot 38 has a length greater than the distance mutually separating side surfaces 16 and 17 of rib 14 in such a way that when the pivot is placed in a symmetrical position with respect to plane 6, pivot 38 forms a projection with respect to two surfaces 16 and 17, respectively, above strips 12 and strip 13. In other words, when the midpoint of pivot 38 is aligned with the central longitudinal axis of rib 14, the pivot 38 projects out from the passage 37 for a substantially equal distance on either side of side surfaces 16 and 17. For example, pivot 38 is defined by planar end surfaces 39 and 40, perpendicular to axis 5, and the separating distance along axis 5 between surfaces 39 and 40 is equal to the distance mutually separating surfaces 9 and 10 with which surfaces 39 and 40 are respectively coplanar when pivot 38 is placed symmetrically with respect to plane 6.

Pivot 38 thus serves as a guide for the rotation of a pivot zone 42 of a support 41 around axis 5 with respect to coupling 18 without any other possibility of relative displacement of the pivot zone 42. The pivot zone 42 is connected at its rear to a boot support zone 43 to which support 41 carries a retention apparatus 44 for securing the front end 3 of boot 4 firmly against boot support element 55 and boot support surface 53, as described in more detail hereinbelow. The retention apparatus 44 can be of any known type which is adapted to be attached between zone 43 of support 41 and the front end 3 of boot 4 or, if desired, between support 41 directly to the boot 4. To this end, a rigid boot support element 55, for example made from metallic material, is attached to the support 41 in zone 43 to cooperate with the front end of the boot 4.

By way of non-limiting example, a retention apparatus 44 is illustrated of the type described in French Patent Application Nos. 2 447 731 and 2 537 011 U.S. Pat. Nos. 4,382,611 and 4,484,762 to which reference will be made, and whose teachings on this subject must be taken into account in connection with this application, and the disclosures of which are hereby incorporated by reference thereto.

Figure 2:
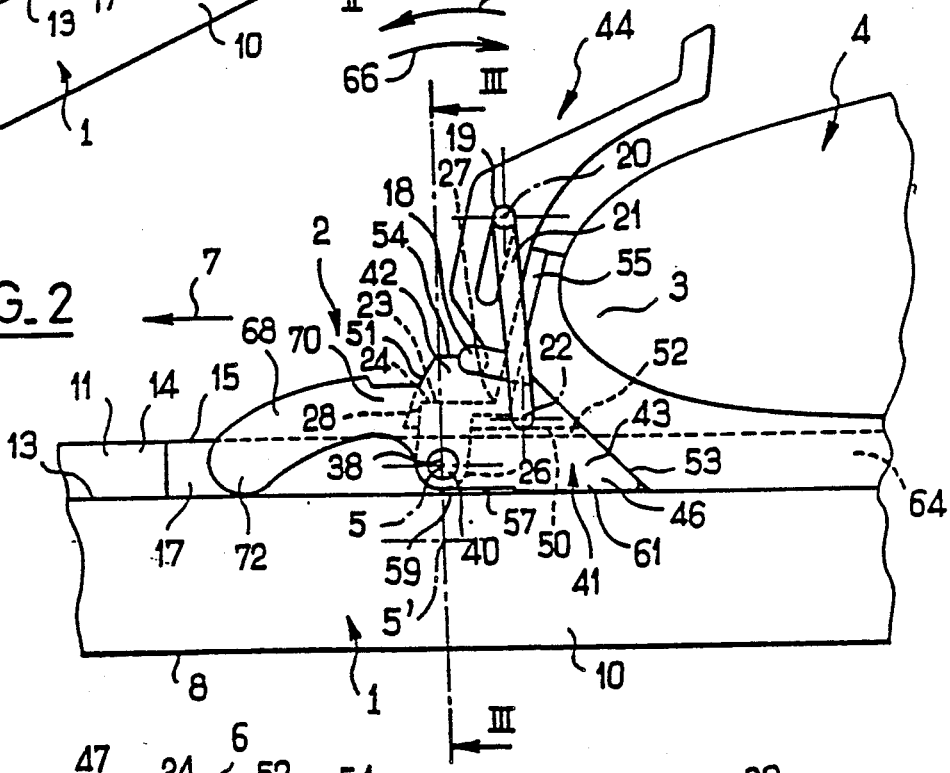
FIG. 2 illustrates a lateral elevational view of the apparatus of FIG. 1 along arrow II of FIG. 1, with a more complete illustration of the retention apparatus.

With reference to the position illustrated in FIG. 2, it should be noted simply that in the case of such an apparatus, rigid boot support element 55, positioned transverse with respect to the longitudinal median plane 6 of the ski and preferably symmetrical with respect to plane 6, forms an upward projection, preferably towards the rear from boot support zone 43 of support 41 to engage in an annular attachment element or coupling 18 fitted to the front end 3 of boot 4. The rigid boot support element 55 provides the boot with a forward support, preferably towards the top. A boot support surface 53, likewise symmetrical with respect to plane 6, is situated lower than boot support element 55 and ascends forwardly. The boot support surface 53 provides the front end 3 of boot 4 with a frontward and downward support. Front end 3 of boot 4 is retained in a removable fashion against boot support element 55 and boot support surface 53 by a movable pressure element 19 positioned in front of boot support element 55 above boot support zone 43 of support 41. Element 19 is journalled, around an axis 20 parallel to axis 5 on a mounting 21 which is itself journalled on zone 43 of support 41 around an axis 22 parallel to axis 5. Consequently, this arrangement applies boot attachment element or coupling 18 downwardly against support 41 by pulling it frontwardly into the position illustrated in FIG. 2. Alternatively, the pressure element 19 may be manipulated to release the pressure on attachment element 18 to free attachment element 18 to slide upwardly with respect to boot support element 55, until a total mutual disengagement between the boot and binding is reached. This alternative, however, is not illustrated in the drawing.

The pivot zone 42 and boot support zone 43 of support 41 are preferably formed from a single body to have a shape adapted to overlap surfaces 15, 16 and 17 rib 14. Thus, zones 42 and 43 of support 41 have, as clearly shown in FIG. 3 with reference to zone 42, the shape of an inverted U when the zones are viewed in cross-section through a plane perpendicular to a longitudinal axis. In this regard, pivot zone 42 and boot support zone 43 have two wings or lateral sections 45 and 46 which are respectively positioned on both sides of rib 14, i.e., respectively facing surfaces 16 and 17 of rib 14. These two wings or lateral sections 45 and 46 are mutually connected above upper surface 15 of rib 14 by a central portion 47. The wings 45 and 46 include planar inner surfaces 48 and 49 which are mutually parallel and symmetric to one another with respect to plane 6, which face and mate facing surfaces 16 and surface 17 of rib 14, respectively. Each of the planar inner surfaces 48 and 49 are spaced perpendicularly with respect to plane 6 by a distance substantially equal to the distance separating surfaces 16 and 17 from rib 14 with which planar inner surfaces 48 and 49 respectively are thus in contact. This arrangement permits mutual sliding of support 41 over a portion of the length of rib 14. Surfaces 48 and 49 thus defined extend upwardly until attaching to the inner surface 50 of central portion 47. Thus, inner surface 50 is positioned to face the top surface 15 of rib 14 providing for a continuous clearance 52 of a constant approximate thickness if one refers to the support position 41 illustrated in FIG. 2.

In the general vicinity above axis 5, inner surface 50 is interrupted towards the front to meet with a transverse front surface 51 of central portion 47, which is planar, ascending towards the rear and oriented essentially perpendicularly to plane 6, when one refers to FIG. 2.

Towards the rear, inner surface 50, as well as surfaces 48 and 49, meet with boot support surface 53, which is planar and perpendicular to plane 6, and ascending towards the front in the position illustrated in FIG. 2. Towards the top and front, boot support surface 53 communicates with front surface 51 by means of upper surface 54 of connection zone or central portion 47. The position illustrated in FIG. 2 shows surface 54 projecting upwardly and towards the rear and carrying boot support element 55 towards the front and top for connection with front end zone 3 of boot 4.

Towards the bottom, the two planar inner surfaces 48 and 49 are connected to respective bottom surfaces 56 and 57 of lateral sections or wings 45 and 46. In general, the bottom surfaces 56 and 57 are perpendicular to plane 6 and symmetrical to one another with respect to this plane. In pivot zone 42, bottom surfaces 56 and 57 are planar, coplanar, and positioned parallel to strips 12 and 13 of upper surface 11 of ski 1, respectively, providing for a clearances 58, 59, as illustrated in FIG. 2. At the rear of axis 5, after a downward bending, for example perpendicular to direction 7 as one views the position illustrated in FIG. 2, surfaces 56 and 57 have respective planar posterior portions **56*a* and 57*a* resting flat against strips 12 and 13, respectively, of the upper surface 11 of ski 1 in the position illustrated in FIG. 2. Towards the rear, these latter portions 56*a* and 57*a* of surfaces 56 and 57 meet with the boot support surface 53** along a cut edge.

In the direction of a spacing from plane 6, lateral sections or wings 45 and 46 of support 41 are defined by respective outer planar surfaces 60 and 61 which are mutually parallel, and symmetrical with respect to one another as well as plane 6, and are preferably positioned coplanar with surfaces 9 and 10, respectively. Thus, surface 60 meets with surfaces 56, 53, 54 and 51 while surface 61 meets with surfaces 57, 53, 54 and 51.

The level of bottom surfaces 56 and 57, particularly when support 41 occupies its position illustrated in FIG. 2, is located intermediate between the lower level of passage 37, i.e., the lower level of pivot 38 which projects from either lateral sides 16, 17 of rib 14, and the level of strips 12 and 13 of upper surface 11 of the ski 1. Thus, axis 5 passes through lateral sections or wings 45 and 46 which are bored on both sides along axis 5, between inner surface 48 and outer surface 60, respectively, of wing 45, and between inner surface 49 and outer surface 61 of wing 46, to form extensions of passages 37 as bores 62 and 63 through wings 45 and 46 for receiving pivot 38.

The two bores 62 and 63 are cylinders of revolution around axis 5 formed to have a diameter substantially identical to that of pivot 38 so as to limit the movement of support 41 with respect to attachment element 18 to rotation about pivot 38 and its axis 5. If pivot 38 is free, particularly for rotation in passage 37, it is attached by any means with support 41 in the bores 62 and 63 to prevent lateral displacement. Alternatively, if pivot 38 is immobilized, particularly against a rotation within passage 37 through rib 14 of ski 1, it is free to rotate around axis 5 in bores 62 and 63 with respect to the wings of support 41.

Figure 3:
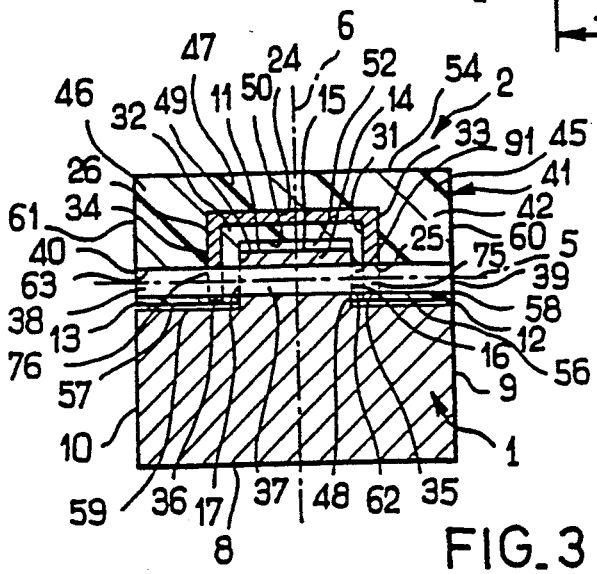
FIG. 3 is a cross-sectional view of the apparatus through the transverse plane identified as III—III in FIG. 2.

Thus, support 41 can occupy the position illustrated in FIGS. 1–3, wherein bottom surfaces 56 and 57 rest against strips 12 and 13 on upper surface 11 of the ski 1 at the rear of axis 5. This permits a boot 4 to be attached by the retention apparatus 44 with the support zone 43 of support 41 as the boot rests on the upper surface of ski 11, preferably wherein the boot is provided with a longitudinal groove in sole 64 which is designed to mate with rib 14 of the ski. The support 41 can also have other configurations not illustrated. In any event, by raising the heel of the boot, support 41 pivots around axis 5 with respect to rib 14 in a direction 65 and moves longitudinally in a forward direction above axis 5. In so doing, the portions of bottom surfaces 56 and 57 which initially rest on strips 12 and 13 of surface 11 of the ski are offset upwardly with respect to strips 12 and 13.

In order to maintain support 41, as illustrated in FIGS. 1–3, in a position that support 41 naturally occupies when the support is not biased in the direction 65 by the previously described movement of boot 4, there is provided elastic means for biasing support 41 to return in direction 66 opposite to direction 65 so as to elastically flatten support 41 at its surfaces 56 and 57 against strips 12 and 13 of the upper surface 11 of ski 1 at the rear of element 18.

According to the present invention, these elastic means for biasing support 41 are integral with support 41, and are preferably formed as a single piece with support 41. As shown in FIG. 1, the means for biasing include two longitudinal tongues 67 and 68 which are positioned on both sides of rib 14 symmetrically to one another with respect to plane 6. Each of the tongues 67 and 68 are elastically flexible and has a respective rear end zone, which is relatively narrow compared to the main body portion of the means for biasing and the support so as to be adapted for flexing in this zone. The rear end zones 69, 70 are thus connected to support 41. As shown, upper rear surfaces **69*a* and 70*a* of the tongues meet with surface 51 of support 41 above journal axis 5 on rib 14. Each of the tongues 67 and 68 also has a respective front end having a bottom portion 71 and 72 which rests respectively on strips 12 and 13 of upper surface 11 of the ski. As described in more detail hereinafter, the tongues 67, 68 are designed to have an arch shape defining a space with strips 12 and 13 of the ski 1, in a rest position. As the boot pivots in a direction 65, however, the arch is flattened against the ski whereby the tongues straighten such that the front ends 71***a*, 71*b* move in a forward direction, i.e., experience a longitudinal displacement with respect to ski 1 by sliding on respective strips 12 and 13. Other support embodiments of tongues 67 and 68 with respect to the ski can be selected without going beyond the scope of the present invention, particularly from the modes of support described in French Patent Application Nos. 2,447,731 and 2,537,011, and U.S. Pat. Nos. 4,382,611 and 4,484,762, the disclosures of which are incorporated herein by reference thereto.

Related to this, the material out of which an integral unit is formed wherein tongues 67 and 68 are joined with zones 42 and 43 of support 41 may be selected from an elastically flexible or substantially rigid material depending upon whether the unit is in the form of a plate, a relatively thin bar, or a comparatively compact block. For example, one can select the materials such as plastic known under the commercial trademarks "ARNYTEL" or "HYTREL", which are polyamides, as well as other materials having properties known to one of skill in the art as functioning in a manner consistent with the described characteristics and function of the binding apparatus without going beyond the scope of the present invention.

In the example illustrated, tongues 67 and 68 are defined by inner surfaces with respect to plane 6 by respective coplanar extensions of planar inner surfaces 48 and 49 of lateral sections 45, 46, respectively, while they are defined by outer surfaces with respect to plane 6 by respective coplanar extensions of planar outer surfaces 60 and 61 of lateral sections 45, 46, respectively. The two tongues 67 and 68 are further defined by top surfaces 73, 74, respectively, by rectilinear generating lines perpendicular to plane 6 to impart a shape to tongues 67 and 68 which, to the rear ends 69 and 70 of tongues 67 and 68, presents a localized narrow portion in the dimension of height. The narrow portion of tongues 67, 68 defines a preferred elastic flexion zone of the binding positioned adjacent and immediately in front of support 41.

According to the present invention, to assure a guidance of boot support element 55 as to its rotation around axis 5 with respect to rib 14 of ski 1 which is as effective as possible despite the inherent flexibility of support 41, boot support element 55, which is rigid, is provided with an integral rigid extension plate 23 which is at least partially embedded in an affixed manner in support 41. The plate 23 includes a base 24 which directly interconnects boot support element 55 to pivot 38, within central portion 47 between the two lateral sections 45 and 46 of support 41.

Figure 4:
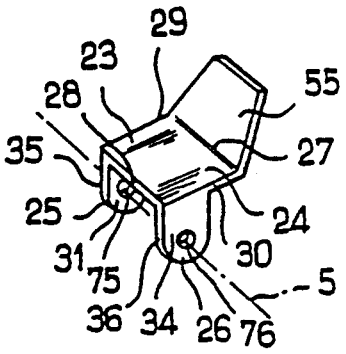
FIG. 4 illustrates a rigid reception element with its extension for coupling with a front end of the boot, in a perspective view analogous to that of FIG. 1.

Preferably, but not necessarily, base 24 of rigid extension plate 23 and boot support element 55 constitute a single rigid element formed out of one piece. As illustrated in FIG. 4, in the case where boot support element 55 has the shape of a flat plate having an average plane perpendicular to the median longitudinal plane 6 of ski 1, the assembly of element 55 and its extension plate 23 can be formed for example by die-casting of a metal sheet.

In the example of this embodiment, rigid extension plate 23 includes a base 24 which is likewise flat, generally horizontal in the position of the support illustrated in FIG. 2, and situated adjacent surface 50 of central portion 47 of the support 41 within which base 24 is integrally embedded. Towards the rear, in front of rear support surface 53 of support 41, the base 24 of rigid extension plate 23 is connected by a rectilinear edge 27, perpendicular to the longitudinal median plane 6 of the ski, to a lower extreme edge of support element 55 while towards the front, base 24 is interrupted at the rear of transverse front surface 51 of support 41 by an edge 28 which is planar and approximately vertical in the position illustrated in FIG. 2, and perpendicular to the longitudinal median plane 6 of the ski. The base 24 is thus positioned vertically above and directly aligned with and above axis 5.

The base 24 is also defined by two side edges 29 and 30 which parallel plane 6 and are symmetrical to one another with respect to plane 6 between the mutual respective spacings of planar surfaces 48 and 49 of lateral sections 45 and 46 and planar outer surfaces 60 and 61 of these lateral surfaces.

The two side edges 29 and 30 of base 24 are connected in an integral fashion to two fins or extensions 25 and 26 of base 24 which project downwardly as side plates below base 24 to provide means for connection of boot support element 55 with pivot 38. As shown, the two extensions 25 and 26 are essentially flat tabs, mutually parallel, and symmetrically spaced apart with respect to one another as well as plane 6. The planar inner surfaces 31 and 32 of fins or tabs 25 and 26, respectively, are likewise mutually parallel, symmetrical with respect to one another and plane 6, and equally spaced by a distance greater than the distance separating surfaces 48 and 49 of lateral sections 45 and 46 of support 41. The extensions or tabs 25 and 26 are also defined in the direction of a spacing with respect to plane 6 by respective planar outer surfaces 33 and 34 which are likewise parallel and symmetrical to one another with respect to plane 6, with a mutual spacing which is less than that of planar outer surfaces 60 and 61 of lateral sections 45 and 46 of support 41. The two lateral sections 25 and 26 are also defined by respective front edges 35 and 36 which are described by generating lines perpendicular to plane 6 and going around the bottom respectively of bore 62 of lateral section 45 and bore 63 of lateral section 46 of support 41 such that lateral sections 25 and 26 are secant to axis 5 on the inside of lateral section 45 and on the inside of lateral section 46, respectively. Along axis 5, the two extensions 25 and 26 are provided with circular orifices 75 and 76, respectively, of revolution around axis 5. Each of the circular orifices 75 and 76 have a somewhat cylindrical inner surface area defining an opening having a diameter substantially identical to that of bores 62 and 63 through lateral sections 45 and 46 for receiving pivot 38. The pivot 38 may be immobilized particularly against a rotation around axis 5 in passage 37 of rib 14 of the ski. Alternatively, the pivot may be free to rotate in passage 37. Preferably, a clearance similar to the clearances 59 is preserved between edge 35 of extension 25 and strip 12 of the upper surface 11 of the ski, on the one hand, and between edge 36 of extension 26 and strip 13 of the upper surface 11 of ski 1, on the other hand. This arrangement permits the previously described pivoting of support 41, in which extension plate 23 of support element 55 is embedded, around axis 5 with respect to rib 14 of ski 1.

Naturally, one of ordinary skill in the art could adapt the embodiments which have just been described without going beyond the scope of the present invention in the case where the mutual journal axis 5 of support 41 and of the ski 1 are at a level below that of strips 12 and 13 of upper surface 11 of the ski as has been schematically shown at 5' in FIG. 2, if desired. For example, in the absence of rib 14, lateral sections 45 and 46 of support 41 and extensions 25 and 26 of rigid extension plate 23, including base 24 of boot support element 55, could be extended so as to seat the wings in respective openings or slotted-out areas in strips 12 and 13 of upper surface 11 of the ski. Likewise, one of ordinary skill in the art could adapt these embodiments in the case of a pivotable linkage 38 with ski 1 by means of an element applied to the ski, regardless of the level of the mutual journal axis of support 41 and of ski 1 and particularly in the case wherein the journal axis is situated above a rib or upper surface area of ski 1, without going beyond the scope of the present invention.

In the case where the mutual journal axis of the support and of the ski does not cut or pass through the ski, either because it is situated above a rib on the upper surface of the ski, such as rib 14, or because it is situated above the upper surface of the ski which is not provided with such a rib, i.e., a ski having an essentially flat or planar surface, one can adapt the embodiments previously described with reference to FIGS. 1–4, by substituting a localized bearing surface for rib 14. In such instances, the bearing surface would be fixed to an upper essentially flat surface of the ski and would have, in a transverse cross-sectional plane at or in the vicinity of the level of axis 5, shapes and dimensions substantially identical to those which have been described with respect to rib 14, as well as with respect to the shapes and dimensions of support 41 which remain otherwise unchanged.

In the case of a ski having an essentially flat or planar upper surface and a journal axis which is positioned above the upper surface of the ski, the binding apparatus can be adapted in accordance with the arrangements illustrated in FIGS. 5–12.

In this regard, reference is initially made to FIGS. 5–8, where numerals 101–111, 118–126, 129–136, 138–144, 153–155, 165, 166, 175, 176 are used for elements corresponding, respectively, to elements 1–11, 18–26, 29–36, 38–44, 53–55, 65, 66, 75, 76, which are identical or which have differences which will be described below.

In this embodiment, where the upper surface 111 of the ski is essentially flat, planar and substantially parallel to the bottom sole surface 106 of the ski, i.e., approximately horizontal in the longitudinal median zone of the ski, the mounting of support 141 for rotation around axis 105 on surface 111 of the ski is effected by means of a rigid frame or stand assembly generally designated 177, connected in an attached fashion, for example by screwing or gluing, on the upper surface 111 of the ski.

To this end, frame 177 includes a base 178 having a planar bottom surface 179 pressed flat against upper surface 111 of the ski, and by a top which may also be planar and parallel to bottom surface 179. Surfaces 179 and 180 are mutually connected by four planar edge surfaces, i.e., by a front edge surface 181, a rear edge surface 182 perpendicular to the direction 107, and two lateral edge surfaces 183 and 184 parallel to the median longitudinal plane 106 of the ski and symmetrical with respect to one another and plane 106, for example with a relative spacing corresponding to that of the side surfaces 109 and 110 of the ski with which the surfaces 183 and 184 are respectively coplanar.

Furthermore, the elements forming rigid frame 177 includes two portions in the form of stanchions 185 and 186 fixed to base plate 178, which project above the top surface 180 of base 179 to level above the level of axis 5. Alternatively, stanchions 185 and 186 can be affixed independently of one another directly on the upper surface 111 of the ski, or may form an integral portion with the upper surface of the ski instead of being attached to base plate 178.

The stanchions 185 and 186 are defined, respectively, by an extension **183*a* which is coplanar with lateral edge surfaces 183 and by a coplanar extension of the lateral edge surfaces 184 of base 178. In the direction facing plane 106, the lateral edge surfaces 183 and 184 are defined by respective planar inner surfaces 187 and 188 which are parallel and positioned symmetrically with respect to one another and plane 106. The two stanchions 185 and 186 are also defined by edges 189 and 190, respectively, defined by generating lines parallel to but spaced apart from axis 105 by a distance greater than the radius of pivot 138. Thus, axis 105 is secant to lateral edge surface 183 and planar inner surface 187 of stanchion 185 as well as lateral edge surfaces 184 and planar inner surface 188 of stanchion 186**.

Along axis 105, the two stanchions 185 and 186 are provided respectively with bores 137' and 137'' which are cylinders of revolution around axis 105 having an opening with a diameter substantially equal to the diameter of pivot 138 to receive the end portions or sections of pivot 138 to permit the relative rotation of pivot 138 around axis 5 or, alternatively, to immobilize pivot 138 with respect to element 177 against such a rotation. It is observed that pivot 138 has substantially planar end surfaces 139 and 140 which are essentially perpendicular to axis 105 and mutually spaced by a distance corresponding to the relative spacing of lateral edge surfaces 183 and 184 of base 178 such that surfaces 139 and 140 respectively are flush with lateral edge surfaces 183 and 184 when pivot 138 is engaged in passages 137' and 137'' by being placed symmetrically with respect to plane 106.

To cooperate with pivot 138, support 141 includes a pivot zone 142 surrounding axis 5 having a size and a shape adapted to be inserted between the portions forming stanchions 185 and 186. Thus, in the embodiment illustrated in FIGS. 5–7, support 141 has in pivot zone 142 a rectangular transverse cross-section defined by an upper surface 154 perpendicular to plane 106 and spaced from axis 105 by a distance greater than the radius of pivot 138, particularly above axis 105. The pivot zone 142 is also defined by a bottom surface 191 similarly perpendicular to plane 106 and positioned below axis 105 at a distance from axis 105 greater than the radius of pivot 138 and less than the distance separating axis 105 from top surface 180 of base plate 178 of rigid frame element 177. Accordingly, there exists between bottom surface 191 and top surface 180 a continuous clearance 192 which is adapted to allow for a pivoting of support 141 around axis 105 with respect to rigid frame 177.

The support 141 is also defined, particularly in pivot zone 142 but similarly in boot support zone 143, in the direction of a spacing with respect to axis 106, by planar outer surfaces 193 and 194 which are parallel and symmetrical with respect to plane 106 in addition to being mutually spaced apart by a distance substantially equal to the distance separating planar inner surfaces 187 and 188. Accordingly, outer surfaces 193 and 194 of support 141 are, respectively, in contact with inner surfaces 187 and 188 of stanchions 185, 186 but permit movement between support 141 and studs 185, 186.

Figure 6:
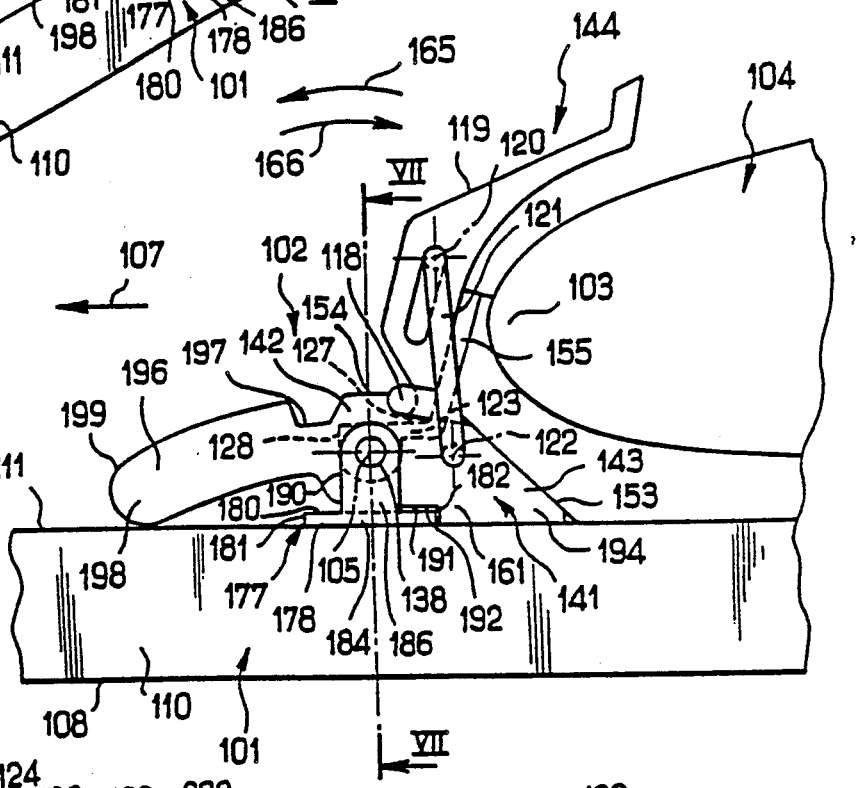

As was noted above with respect to bottom surfaces 56 and 57 of lateral sections 45 and 46 of support 41, bottom surface 191 of support 141 bends downwardly between zone pivot 142 and boot support zone 143. As illustrated in FIG. 6, at the rear edge surface 182 of base 178 of rigid frame 177 there is a planar zone adapted to rest substantially flat against upper surface 111 of the ski. As shown in FIG. 6, this planar zone is connected towards the rear to boot support surface 153 which in turn meets with upper surface 154 of support 141 such that boot support element 155 for the front end 103 of boot 104 projects in the vicinity of the junction of boot support surface 153 and upper surface 154.

Along axis 105, boot zone 142 of support 141 is bored through to have a passage 195 which is a cylinder of revolution around axis 105 having a diameter substantially identical to that of pivot 138. As in the previously discussed embodiments, pivot 138 may be immobilized against a rotation around axis 105 with respect to support 141 or, alternatively, may be adapted to rotate around axis 105 in bores 137′ and 137″ of stanchions 185 and 186 of rigid frame 177 If pivot 138 is immobilized, particularly against such a rotation in bores 137′ and 137″ of stanchions 185 and 186 of element 177, support 141 is adapted to pivot about axis 105.

In a characteristic fashion of the invention, support 141 has a longitudinal tongue 196 which is elastically flexible and situated in front of zone 142 of support 141. The tongue 196 is connected to the front of zone 142 by a rear end portion 197 which is relatively narrow with respect to the height of zone 142. Thus rear end portion of tongue 97 defines a preferred flexion zone of tongue 196. The tongue 196 rests at the bottom of front end portion 198 against the upper surface 111 of ski 101 and may be made from a single piece of elastically flexible, plastic material as was described with respect to support 41 and tongues 67 and 68. Nevertheless, it should be understood that the illustrated method of supporting the elastically flexible tongue 196 at the bottom of front end portion 198 with respect to ski 101 is not characteristic of the present invention. In this regard, tongue 196 is defined by respective coplanar extensions of planar outer surfaces 193 and 194 of support 141 in the direction of a spacing with respect to plane 106, and is further defined by nose surface 199 defined by generating lines perpendicular to plane 106, with a shape adapted to define the localized narrowing described above at the level of the rear end 197 portion of tongue 196.

According to the present invention, rigid boot support element 155, which is fixed to retention apparatus 144 for the retention of front end zone 103 of boot 104 with respect to rear zone 143 of support 141, extends within boot support zone 143 and pivot zone 142 of support 141 in the form of a rigid extension plate 123 which is in the form of a base 124 rigidly affixed to boot support element 155. As will be clear from a comparison between FIGS. 8 and 4, this extension plate 123 has a structure and a shape which in every way is comparable to the structure and shape of rigid extension plate 23 of support element 55, except that instead or connecting directly to side edges 129 and 130 of base 124, front edges of extensions 135 and 136 are connected to the base 124 by means of lateral base surface areas, 200 and 201, which project laterally with respect to edge 129 and edge 130, perpendicularly with respect to the longitudinal median plane 6 of the ski, and generally horizontally relative to the position of support 141 and of extension 123 illustrated in FIG. 6. The base 124 is itself substantially horizontal in this position, and is positioned between pivot 138 and the upper surface 154 of support 141. The base 124 is defined in part by front edge 128 located in front of axis 105 but at the rear of the meeting of rear end portion 197 of tongue 196 with zone 142 of support 141, while edge 127 forming the bend connecting rigid extension plate 123 towards the rear with support element 155 is situated in front of rear support surface 153 of support 141 such that this rigid extension plate 123 is integrally lodged or embedded in support 141. In addition respective planar outer surfaces 133 and 134 of fins or extensions 125 and 126 of rigid extension plate 123 are mutually spaced by a distance less than the distance mutually separating outer surfaces 193 and 194 from support 141. Related to this, front edges 135 and 136 which extend around passage 195 at the bottom are preferably situated between this passage 195 and bottom surface 191 of support 141, which may if desired be flush with the bottom surface so as to not constitute a hindrance to the pivoting of support 141 with respect to rigid frame element 177 around axis 105. The circular orifices 175 and 176 of fins or extensions 125, 126 are dimensioned as a function of the affixation of pivot 138 either in support 141, or in ski 101, or by means of rigid frame 177.

The shape of the rigid extension plate 123 of the rigid boot support element 155 within support 141 can be different from the shape which has just been described, in particular when support 141 and rigid extension 123 are pivotally mounted between two stanchions 185 and 186 of rigid frame 177 which serves as an intermediary for mounting the binding apparatus on ski 101.

Figure 5:
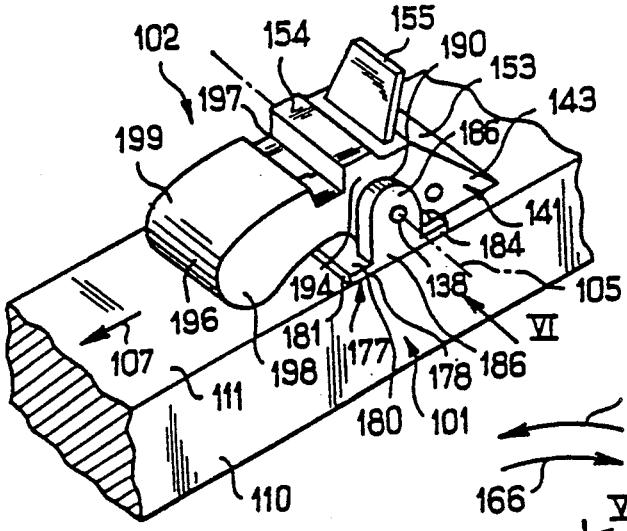
Figure 7:
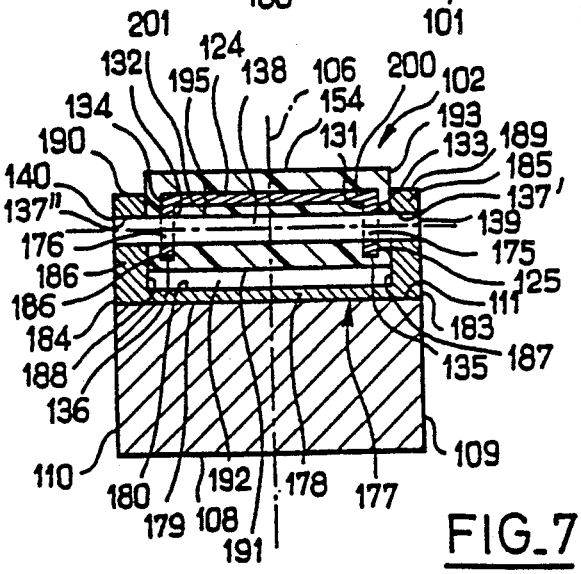
Figure 8:
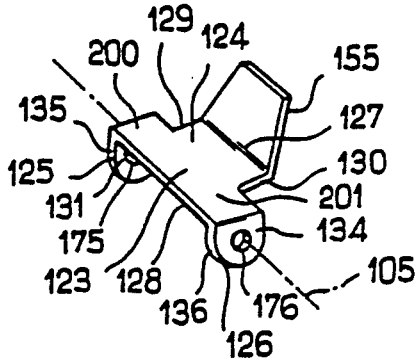

Turning now to FIGS. 9 and 10, and 11 and 12, respectively, two different configurations of the boot support element 155 are illustrated in an apparatus which is otherwise identical to that which has been described with reference to FIGS. 5-7. In FIGS. 9-12, therefore, the same reference numerals were used as in FIGS. 5-7 to designate the same elements of the apparatus for these embodiments.

Figure 9:
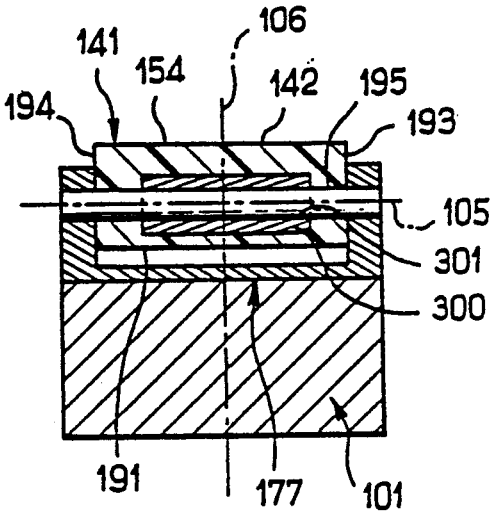
FIGS. 9 and 10 are views analogous, respectively, to those of FIGS. 7 and 8, showing a first variation of this second embodiment.
Figure 10:
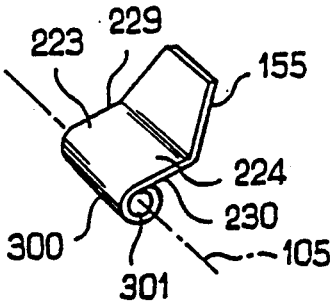

In the embodiments shown in FIGS. 9 and 10, rigid extension plate 223 of boot support element 155 includes a base 224 which is entirely comparable to base 124 of rigid extension plate 123 described with reference to FIGS. 5-8, as to its orientation and positioning within pivot zone 142 of support 141. However, instead of fins or extensions comparable to fins 125 and 126, base 224 is attached at its bottom, in a fashion which is affixed and preferably formed out of a single piece, a tubular sleeve 300 positioned along axis 5 and defining a tunnel 301 which is a cylinder of revolution around axis 105 with a diameter calculated in a manner similar to that of circular orifices 175 and 176 described with reference to FIGS. 5-8. As will be clear from an examination of FIG. 9, sleeve 300 is dimensioned so as to be integrally lodged or embedded between passage 195 through pivot zone 142 of support 141 and, respectively, upper surfaces 154 and bottom surface 191. The sleeve 300, when positioned symmetrically with respect to median longitudinal plane 106 of the ski, has perpendicularly to plane 106, i.e., along axis 105, dimensions less than the distance mutually separating planar outer surfaces 193 and 194 of support 141. This is also the case for the distance mutually separating side edges 229 and 230 of plate 224, which is similarly comparable to side edges 129 and 130 of plate 124 of extension 123.

Figure 11:
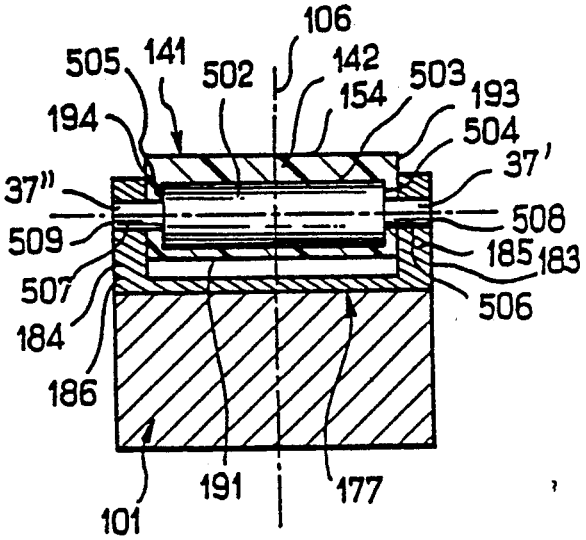
FIGS. 11 and 12 are views analogous, respectively, to those of FIGS. 7 and 8, showing another alternative of this second embodiment.
Figure 12:
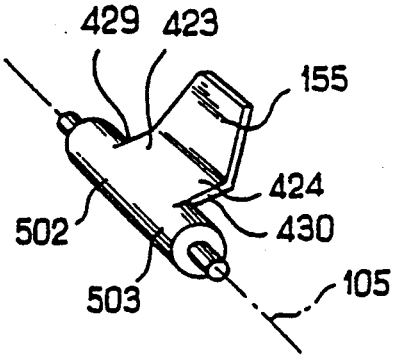

In the case of the embodiment of FIGS. 11 and 12, rigid extension plate 423 of boot support element 155 within support 141 include a base 424 which is essentially the same as base 224 defined by side edges 429 and 430 which are substantially comparable to side edges 229 and 230, respectively.

Towards the bottom, in a position which is substantially comparable to that of sleeve 300 with respect to plate 224, base 424 is attached in a fixed fashion to a rigid massive element 502 formed of a single piece or assembly which is defined by a cylindrical surface of revolution 503 around axis 105. Element 502 has a radius less than the least of the distances separating axis 105 from upper surface 154 and bottom surface 191 from support 141, respectively. Element 502 is defined perpendicularly with respect to axis 105 by two annular planar surfaces 504 and 505 of revolution around axis 105. In the direction of a distancing with respect to plane 106, the annular planar surfaces 504 and 505 are symmetrical to one another with respect to plane 6 and mutually spaced by a distance less than the distance separating planar outer surfaces 193 and 194 of support 141 in zone 142 such that element 502 is integrally embedded within zone 142 of support 141. Along axis 105, each of surfaces 504 and 505 is provided with an integral journal 506 and 507 having a peripheral cylinder of revolution around axis 105 with a diameter substantially identical to that of respective openings 37' and 37" in stanchions 185 and 186 of the rigid frame element 177. This arrangement permits a relative rotation between journals 506 and 507, on the one hand, and stanchions 185 and 186, on the other hand. To this end, journals 506 and 507, symmetrical to one another with respect to plane 106, are defined in the direction of a spacing with respect to plane 106 by respective planar surfaces 508 and 509 which are both spaced by a distance identical to the distance separating lateral edge surfaces 183 and 184 so as to be flush with lateral edge surfaces 183 and 184.

In the case of a ski whose upper surface has a longitudinal rib, such as rib 14 of the embodiment illustrated in FIGS. 1–4, one can utilize a mounting assembly of the type illustrated in FIGS. 13–16. In such an embodiment, given by way of non-limiting example, the pivot or journal axis is situated above the rib, regardless of the height of the mutual journal axis of the support and of the ski with respect to the rib.

Related to this, FIGS. 13–16 illustrate essentially the same elements as shown in FIG. 1–4 identified by similar reference numerals increased by 500, which are substantially the same as different in certain respects as described herein. In this regard a notable difference is that surfaces 616 and 617 of rib 614 converge mutually in a forward direction instead of being mutually parallel. In addition the mutual journal axis of support 641 and of the ski 601 is located perpendicularly to the longitudinal median plane 606 of the ski above the upper surface 615 of rib 614, as schematically shown as axis 605". Alternatively, such an axis can also pass through the rib in the fashion of axis 5, schematically shown as axis 605 in FIG. 14, or can pass through the ski below the rib in the fashion of axis 5', as shown schematically as axis 605' in FIG. 14.

In the embodiment shown in FIGS. 13–16, the journalled linkage of support 641 and of ski 601 is assured by an intermediate mounting element referred to as a platform 677 including a longitudinal central zone 708 which is bordered by two longitudinal lateral zones 709 and 710. The platform 677 thus overlaps rib 614, as well as covers strip 613 on the upper surface in the median longitudinal mounting zone of ski 601, with which element 677 may be attached by any appropriate means, such as screws or adhesive.

The lateral zones 709 and 710 of platform 677 serve as an intermediate for support and as means for sliding front ends 671 and 672 of tongues 667 and 668 longitudinally over strips 612 and 613 on surface 611 of the ski as is described in French Patent Application No. 86.07227 and its corresponding U.S. Ser. No. 1,383, being filed concurrently herewith, commonly owned with the present application, the disclosure of which is hereby incorporated by reference thereto.

The central zone 708 of element 677 has a substantially rectangular transverse cross-section which is similar in substantially every respect to the rectangular transverse cross-section of rib 14, and has comparable dimensions to the dimensions of support 641, which are in essentially the same relationship to the dimensions of rib 14 relative to those of support 41. This arrangement allows for substantially similar relative pivoting around axis 605, 605', 605" as around axis 5 or 5', without permitting relative movement parallel to such axis.

As illustrated, when the mutual journal axis 605" of support 641 and of ski 601 is situated above rib 614, pivot 638, engaged at opposite ends in respective openings 662 and 663 of lateral sections 645 and 646 of support 641, spans between these lateral sections through passage 637. Passage 637 is comparable to passage 37 except that passage 637 is provided in mounting element or platform 677, and specifically in a raised area 711 of mounting element 677 located above rib 614. When the pivot axis is situated as indicated at 605 or at 605', an appropriate configuration of the intermediate mounting element 677 is provided such that the passage 637 in mounting element 677 is replaced by coaxial openings located in mounting element 677 and in ski 601, respectively, in a manner similar to what is described in French Patent Application No. 86.07227, and its corresponding U.S. Ser. Co. 51,383, being filed concurrently herewith, commonly owned with the present application, the disclosure of which is hereby incorporated by reference thereto. This is similar to the situation where a journal axis passes through the ski at the level of the rib on the upper surface thereof.

The rigid extension plate 623 of support element 655 for the front end 603 of boot 604 is embedded in support 641 as was explained with respect to extension plate 23 of support element 55 within support 41. In order to accommodate relative spacing of inner surfaces 648 and 649 of lateral sections 645 and 646 of support 641 greater than that of surfaces 48 and 49 of lateral surface 45 and 46 of support 41, the general shape of rigid extension plate 623, more clearly illustrated in FIG. 16, is essentially the same as the shape illustrated in FIG. 8. In other respects, extensions 635 and 636 of rigid extension plate 623 connect to base 624 by means of flat lateral base surface areas 700 and 701, respectively, such that base 624 is coplanar to itself in projection with respect to its side edges 629 and 630, respectively, which are located perpendicularly to the longitudinal median plane 606 of ski 601.

One of ordinary skill in the art will easily understand that other embodiments and configurations of the rigid extension plate of support element 55, 155, 655 for support of front end 3, 103, 603 of boot 4, 104, 604 within support 41, 141, 641 may be used, and that such elements may be formed of an elastically flexible material which can be provided without going beyond the scope of the present invention. Likewise, the shape of support 41, 141, 641 so as to integrate the elastic means for biasing in the direction 66, 166, 666 can vary over a large extent without going beyond the scope of the invention.

Finally, although the invention has been described with reference to particular means, materials and embodiments, it is to be understood that the invention is not limited to the particulars disclosed but extends to all equivalents within the scope of the claims. Thus, from the foregoing description one skilled in the art can easily ascertain the essential characteristics of the invention and without departing from the spirit and scope thereof, can make various changes and modifications of the invention and adapt it to various usages and conditions.

What is claimed is:

1. An apparatus for linking a boot to a ski comprising:

(a) a support, formed at least partially from elastic, flexible material, having a longitudinal axis and a transverse axis, said support having a central portion and lateral sections provided with a cylindrical passage with a longitudinal axis coincident with said transverse axis and being adapted to be mounted to a surface on said ski for pivoting about said transverse axis, said central portion having a bottom surface and said lateral sections having lower surfaces located below said bottom surface for contact with said surface on said ski, wherein said central portion and said lateral sections define an open area adapted to mate with a raised area on said surface of said ski;

(b) means for biasing at least a portion of said support against said surface, said means for biasing being formed at least partially from elastic, flexible material, being unitary with said support, and being connected to one end of said support, said means for biasing further having an arched underside and an end portion opposite the end connected to said support for contacting said surface on the ski;

(c) means for attachment to said boot including:

(i) an element for attachment to said boot; and (ii) a pivot portion through which said transverse axis extends, said pivot portion being unitary with said element, being at least partially embedded within said support, and having an extension defining a circular area having a center coincident with said transverse axis; and (d) a journal extending through said cylindrical passage and said circular area.

2. The apparatus for linking a boot to a ski in accordance with claim 1, wherein said means for biasing include two members, each of said members being fixed to one end of each of said lateral sections of said support.

3. The apparatus for linking a boot to a ski in accordance with claim 2, wherein said pivot portion has opposite side edges, and said means for attachment further includes:

(iii) side plates extending downwardly from said opposite side edges of said pivot portion, said side plates being parallel to each other and perpendicular to said transverse axis, each of said side plates being provided with a circular opening describing said circular area having a diameter essentially the same as the diameter of said cylindrical passage for receiving end portions of said journal.

4. The apparatus for linking a boot to a ski in accordance with claim 3, wherein said surface on a ski is a platform adapted to be fitted on top of a ski.

5. The apparatus for linking a boot to a ski in accordance with claim 1, wherein said element and said pivot portion of said means for attachment are rigid.

6. The apparatus for linking a boot to a ski in accordance with claim 1, wherein said element and said pivot portion of said means for attachment are more rigid than said support.

7. The apparatus for linking a boot to a ski in accordance with claim 1, wherein said transverse axis of said support is adapted, when mounted to said surface on said ski, to remain fixed relative to said ski during use of said apparatus.

8. The apparatus for linking a boot to a ski in accordance with claim 1, further comprising means for substantially rigidly mounting said pivot portion of said means for attachment for pivoting about said transverse axis of said support to prevent substantial torsional movement of said transverse axis about said longitudinal axis of said support.

9. An apparatus for skiing comprising:

(A) a ski having a top side; and (B) a linkage apparatus attached to said top side of said ski including:

(a) a support, formed at least partially from elastic, flexible material, having a longitudinal axis and a transverse axis, said support having a cylindrical passage with a longitudinal axis coincident with said transverse axis and being adapted to be mounted to a surface on said ski for pivoting about said transverse axis, said support further comprising a central portion and adjacent lateral sections, said central portion having a bottom surface and said lateral sections having lower surfaces located below said bottom surface for contact with said surface on the ski;

(b) means for biasing at least a portion of said support against said surface on said ski, said means for biasing being formed at least partially from elastic, flexible material, being unitary with said support, and being attached to one end of said support, said means for biasing further having an arched underside and an end portion opposite the end attached to said support for contacting said surface on the ski;

(c) means for attachment to said boot connected to said support including:

(i) an element for attachment to said boot; and (ii) a pivot portion through which said transverse axis extends, said pivot portion being unitary with said element, being at least partially embedded within said support, and having a lower extension defining an open circular area having a center coincident with said transverse axis; and (d) a journal extending through said cylindrical passage and said open circular area, wherein said adjacent lateral sections of said support have bores for receiving said journal, positioned on either side of said central portion of said support.

10. The apparatus for skiing in accordance with claim 9, wherein said lower surfaces are fixed to a surface on said ski.

11. The apparatus for skiing in accordance with claim 10, wherein said surface on said ski is a base attached to said top side of said ski.

12. The apparatus for skiing in accordance with claim 11, wherein said lateral sections are stanchions and form a frame with said base for pivotally mounting said linkage apparatus on said ski by means of said journal extending through said passage in said support member, said open circular area of said lower extension of said means for attachment and said bores in said stanchions.

13. The apparatus for skiing in accordance with claim 12, wherein said extended section of said means for attachment has a width, and said pivot portion has a surface area with a width greater than the width of said element.

14. The apparatus for skiing in accordance with claim 13, wherein said surface area of said pivot portion has side edges and said lower extension includes side plates attached to said side edges.

15. The apparatus for skiing in accordance with claim 13, wherein said surface area of said pivot portion forms a portion of said lower extension, said lower extension having a hollow central area for receiving said journal.

16. The apparatus for skiing in accordance with claim 15, wherein said journal is fixed in said hollow central area.

17. The apparatus for skiing in accordance with claim 9, wherein said means for biasing are fixed at one end of each of said lateral sections of said support.

18. The apparatus for skiing in accordance with claim 17, wherein said pivot portion has opposite side edges, and said lower extension includes side plates extending downwardly from said edges of said pivot portion, said side plates being parallel to each other and perpendicular to said transverse axis, each of said plates being provided with a circular opening describing said circular area having a diameter essentially the same as the diameter of said cylindrical passage for receiving end sections of said journal.

19. The apparatus for skiing in accordance with claim 18, wherein said upper surface of a ski includes a longitudinally extending rib having a top surface and longitudinal laterally adjacent surfaces.

20. The apparatus for skiing in accordance with claim 19, wherein said top surface of said rib and said top side of said ski lie in a common horizontal plane.

21. The apparatus for skiing in accordance with claim 19, wherein said longitudinally extending rib includes lateral sides extending between said top surface and said laterally adjacent surfaces.

22. The apparatus for skiing in accordance with claim 21, wherein said lateral sides mutually converge in a forward direction.

23. The apparatus for skiing in accordance with claim 21, wherein said lateral sides are mutually parallel over at least a section of said rib.

24. The apparatus for skiing in accordance with claim 23, wherein said surface on a ski is a platform fitted to overlap said section of said rib.

25. The apparatus for skiing in accordance with claim 9, wherein said element and said pivot portion of said means for attachment are rigid.

26. The apparatus for skiing in accordance with claim 9, wherein said element and said pivot portion of said means for attachment are more rigid than said support.

27. The apparatus for skiing in accordance with claim 9, wherein said transverse axis of said support, when mounted to said surface on said ski, remains fixed relative to said ski during use of said apparatus.

28. The apparatus for skiing in accordance with claim 9, further comprising means for substantially rigidly mounting said pivot portion of said means for attachment for pivoting about said transverse axis of said support to prevent substantial torsional movement of said transverse axis about said longitudinal axis of said support.

29. A skiing apparatus including a linkage coupling apparatus for a front end of a boot to a ski comprising:

(a) a support provided with a cylindrical passage having an axis coincident with an axis transverse to a longitudinal axis of said ski, said support being adapted to be pivotally mounted about said transverse axis to said ski;

(b) means for supporting a front end of a boot connected to said support, said means for supporting including:

(i) a base plate at least partially embedded in said support secant to said transverse axis and adapted to be pivotally connected about said transverse axis;

(ii) an elongate member unitary with said base plate and extending from one end of said base plate and extending outwardly from an end of said support, said elongate element being adapted to cooperate with means for attachment to said boot; and (iii) mutually parallel side plates attached to said base plate perpendicular to said transverse axis, having openings with a center coincident with said transverse axis and adapted to receive a journal;

(c) means for biasing said support about said transverse axis with respect to said ski attached to another end of said support, said means for biasing being unitary with said support;

(d) a ski having a longitudinal raised top portion provided with a tunnel along an axis coincident with said transverse axis; and (e) a journal extending along said transverse axis through said tunnel, said passage and said openings to pivotally connect said linkage to said ski.

30. The linkage apparatus in accordance with claim 29, wherein said side plates are positioned at each side of said raised top portion.

31. The linkage apparatus in accordance with claim 30, wherein said raised top portion is a longitudinal rib positioned secant to said transverse axis.

32. The linkage apparatus in accordance with claim 31, wherein said rib is an integral part of said ski.

33. The linkage apparatus in accordance with claim 31, wherein said rib is attached to a top surface area of said ski.

34. The linkage apparatus in accordance with claim 31, wherein said means for biasing includes at least one flexible member having an arched underside and a free end with a bottom portion for contacting an upper surface on said ski.

35. The linkage apparatus in accordance with claim 34, wherein said support is made from flexible elastic material and said means for biasing includes a said flexible member positioned on each side of said rib.

36. The linkage apparatus in accordance with claim 24, wherein both of said base plate and said elongate member are rigid.

37. The linkage apparatus in accordance with claim 29, wherein said elongate member is more rigid than said support.

38. The skiing apparatus in accordance with claim 29, wherein said transverse axis of said support is adapted, when mounted to said ski, to remain fixed relative to said ski during use of said apparatus.

39. The skiing apparatus in accordance with claim 29, further comprising means for substantially rigidly mounting said base plate for pivoting about said transverse axis of said support to prevent substantial torsional movement of said transverse axis about said longitudinal axis of support.

* * * * *

PRINTER'S TRIM LINE

UNITED STATES PATENT AND TRADEMARK OFFICE

CERTIFICATE OF CORRECTION

PATENT NO. : 4,998,746

DATED : March 12, 1991

INVENTOR(S) : Paul ARNULF

It is certified that error appears in the above-identified patent and that said Letters Patent is hereby corrected as shown below:

At column 1, line 58, change "447 731" to ---2 447 731---.

At column 9, line 27, insert ---.--- after "6".
At column 17, line 25, insert ---.--- after "177".
At column 20, line 12, change "1,383" to ---51,383---.
At column 24, line 67 (claim 36, line 2), change "24" to ---29---.

Signed and Sealed this

Ninth Day of February, 1993

*Attest:*

STEPHEN G. KUNIN

*Attesting Officer*

*Acting Commissioner of Patents and Trademarks*